US010415214B2

(12) United States Patent
Kishida et al.

(10) Patent No.: US 10,415,214 B2
(45) Date of Patent: Sep. 17, 2019

(54) HYDRAULIC CIRCUIT AND WORKING MACHINE

(71) Applicant: Caterpillar SARL, Geneva (CH)

(72) Inventors: Kouji Kishida, Tokyo (JP); Mitsuhiro Toyoda, Tokyo (JP); Yoshihiko Hata, Tokyo (JP); Yuya Kanenawa, Tokyo (JP); Shuhei Orimoto, Tokyo (JP); Nobuaki Matoba, Hyogo (JP)

(73) Assignee: Caterpilalr SARL, Geneva (CH)

( * ) Notice: Subject to any disclaimer, the term of this patent is extended or adjusted under 35 U.S.C. 154(b) by 102 days.

(21) Appl. No.: 15/568,076

(22) PCT Filed: Apr. 20, 2016

(86) PCT No.: PCT/EP2016/058677
§ 371 (c)(1),
(2) Date: Oct. 20, 2017

(87) PCT Pub. No.: WO2016/169936
PCT Pub. Date: Oct. 27, 2016

(65) Prior Publication Data

US 2018/0142444 A1 May 24, 2018

(30) Foreign Application Priority Data

Apr. 21, 2015 (JP) ..... 2015-086579

(51) Int. Cl.
*E02F 9/22* (2006.01)
*F15B 15/18* (2006.01)

(52) U.S. Cl.
CPC ..... *E02F 9/2217* (2013.01); *E02F 9/2292* (2013.01); *E02F 9/2296* (2013.01); *F15B 15/18* (2013.01)

(58) Field of Classification Search
CPC ..... F15B 1/024; F15B 13/06; F15B 21/14; E02F 9/2217; E02F 9/2267
See application file for complete search history.

(56) References Cited

U.S. PATENT DOCUMENTS 5,477,677 A * 12/1995 Krnavek ..... E02F 9/2217 60/414
9,051,944 B2 * 6/2015 Wen ..... E02F 9/2217
(Continued)

FOREIGN PATENT DOCUMENTS

EP 2589823 A1 5/2013
JP S57-129906 A 8/1982
(Continued)

*Primary Examiner* — F Daniel Lopez
*Assistant Examiner* — Matthew Wiblin

(57) ABSTRACT

Provided are a hydraulic circuit and a work machine capable of improving an initial motion speed of a hydraulic cylinder during a contraction of the hydraulic cylinder and securing a necessary pump flow rate while hydraulic fluid is being accumulated in an accumulator. Hydraulic oil from a head side of a second boom cylinder is regenerated in a first boom cylinder and the second boom cylinder through a second control valve of a regeneration circuit. At the same time, oil from the head side of the first boom cylinder is accumulated to a first accumulator by a pressure accumulating circuit through a first control valve. The hydraulic oil supplied under pressure from a main pump is fed to a rod side of the first boom cylinder by a boom control valve. A bleed-off valve of a bleed-off circuit communicates the first control valve to a tank at the time of initial operation of the first control valve, thereby releasing hydraulic oil from the head end of the first boom cylinder to improve an initial motion speed.

4 Claims, 10 Drawing Sheets

(56) References Cited

U.S. PATENT DOCUMENTS

| | | | | |
|---|---|---|---|---|
| 9,593,467 | B2 * | 3/2017 | Kajita | F15B 21/14 |
| 2003/0213238 | A1 * | 11/2003 | Smith | E02F 9/2217 60/413 |
| 2004/0006980 | A1 * | 1/2004 | Berthod | E02F 9/2207 60/413 |
| 2008/0110166 | A1 * | 5/2008 | Stephenson | E02F 9/2217 60/414 |
| 2009/0000290 | A1 | 1/2009 | Brinkman | |
| 2009/0025379 | A1 * | 1/2009 | White | B66C 13/20 60/413 |
| 2010/0018195 | A1 * | 1/2010 | Stanger | E02F 9/2217 60/414 |

FOREIGN PATENT DOCUMENTS

| | | | |
|---|---|---|---|
| JP | H04095602 | A | 3/1992 |
| JP | 2007170485 | A | 7/2007 |
| JP | 2009275775 | A | 11/2009 |
| WO | 2014/115645 | A1 | 7/2014 |

* cited by examiner

HYDRAULIC CIRCUIT AND WORKING MACHINE

CROSS-REFERENCE TO RELATED APPLICATIONS

This application is a national phase application of International Patent Application No. PCT/EP2016/058677 filed Apr. 20, 2016, which claims priority to Japanese Patent Application No. 2015-086579 filed Apr. 21, 2015, both of which are incorporated by reference herein in their entireties for all purposes.

TECHNICAL FIELD

The present invention relates to a hydraulic circuit provided with an accumulator, and a working machine equipped with the hydraulic circuit.

BACKGROUND ART

A working machine is configured to accumulate, in an accumulator, pressure oil that is discharged from a boom hydraulic cylinder when lowering the boom, and to also accumulate, in the accumulator, pressure oil that is relieved from a slewing hydraulic motor when accelerating/decelerating the slewing operation (see, PTL 1, for example).

CITATION LIST

Patent Literature

[PTL 1] Japanese Patent Application Publication No. 2010-84888

SUMMARY OF INVENTION

Technical Problem

Since the pressure oil discharged from the boom hydraulic cylinder cannot be regenerated to the boom hydraulic cylinder during the accumulation of this pressure oil in the accumulator, a necessary pump flow rate cannot be ensured, slowing down the operating speed of the boom hydraulic cylinder. In addition, the initial speed of the boom hydraulic cylinder needs to be ensured even when the pressure oil discharged from the boom hydraulic cylinder is regenerated to ensure a pump flow rate. Therefore, it is desired that a simpler configuration be employed to regenerate the pressure oil discharged from the boom hydraulic cylinder while ensuring the initial speed of the boom hydraulic cylinder, to ensure a necessary pump flow rate.

The present invention was contrived in view of these circumstances, and an object thereof is to provide a hydraulic circuit and a working machine that are capable of, with a simpler configuration, improving the initial speed of contraction of a hydraulic cylinder and ensuring a necessary pump flow rate even when a working fluid is being accumulated in an accumulator.

Solution to Problem

An invention described in claim 1 is a hydraulic circuit having: a plurality of hydraulic cylinders that simultaneously actuate the same operation by using a working fluid that is pressurized and supplied by a pump in response to an operation of an operating device; an accumulator in which the working fluid is accumulated; an accumulation circuit that is provided with a first valve for changing the amount of communication between a head of a first hydraulic cylinder of the plurality of hydraulic cylinders and the accumulator in accordance with an operation amount of the operating device, and accumulates a working fluid, which is ejected from the head of the first hydraulic cylinder, in the accumulator through the first valve; a regenerative circuit that is provided with a second valve for blocking communication between heads of the plurality of hydraulic cylinders and enabling communication between the head of a second hydraulic cylinder of the plurality of hydraulic cylinders and rods of the first and second hydraulic cylinders when the accumulation circuit accumulates the working fluid in the accumulator, and regenerates a working fluid, which is ejected from the head of the second hydraulic cylinder, to the first and second hydraulic cylinders through the second valve; a bleed-off circuit that is provided with a third valve for switching between enabling and blocking communication between the first valve and a tank, and returns the working fluid from the first valve to the tank through the third valve at initial operation of the first valve; and a main valve that supplies the working fluid pressurized and supplied by the pump, to the rod of the first hydraulic cylinder while the first valve and the tank communicate with each other by the third valve.

Advantageous Effects of Invention

According to the invention described in claim 1, in order to accumulate in the accumulator the working fluid ejected from the head of the first hydraulic cylinder through the first valve with the accumulation circuit and the regenerative circuit being separated from each other, the working fluid is returned to the tank by the bleed-off circuit at initial operation of the first valve, while the working fluid from the pump is supplied to the rod of the first hydraulic cylinder through the main valve. Therefore, the initial speed of contraction of the hydraulic cylinders can be improved. In addition, at the same time with the accumulation of the working fluid in the accumulator, the working fluid ejected from the head of the second hydraulic cylinder is regenerated to the rods of the first and second hydraulic cylinders through the second valve, reducing the regeneration flow rate of the pump at the time of the accumulation of the working fluid in the accumulator, and easily ensuring the necessary pump flow rate with a simple configuration.

According to the invention described in claim 2, some of the working fluid ejected from the head of the first hydraulic cylinder is accumulated in the accumulator through the first valve, while the rest of the working fluid is regenerated to the rod of the first hydraulic cylinder through the fourth valve of the auxiliary regenerative circuit. Therefore, the regeneration flow rate of the pump at the time of the accumulation of the working fluid in the accumulator can further be reduced, and the necessary pump rate can be ensured with a simple configuration.

According to the invention described in claim 3, the third valve changes the amount of communication between the first valve and the tank in accordance with the operation amount of the operating device and the accumulator pressure. Such a configuration can effectively return the working fluid, which is ejected from the head of the first hydraulic cylinder, to the tank, adequately improving the initial speed of contraction of the hydraulic cylinders.

The invention described in claim 4 can improve the initial speed of lowering the working device of the working machine and reduce the regeneration flow rate of the pump at the time of the accumulation in the accumulator when lowering the working device, easily ensuring the necessary pump flow rate.

DESCRIPTION OF EMBODIMENTS

The present invention is described hereinafter in detail based on an embodiment shown in FIGS. 1 to 11.

Figure 11:
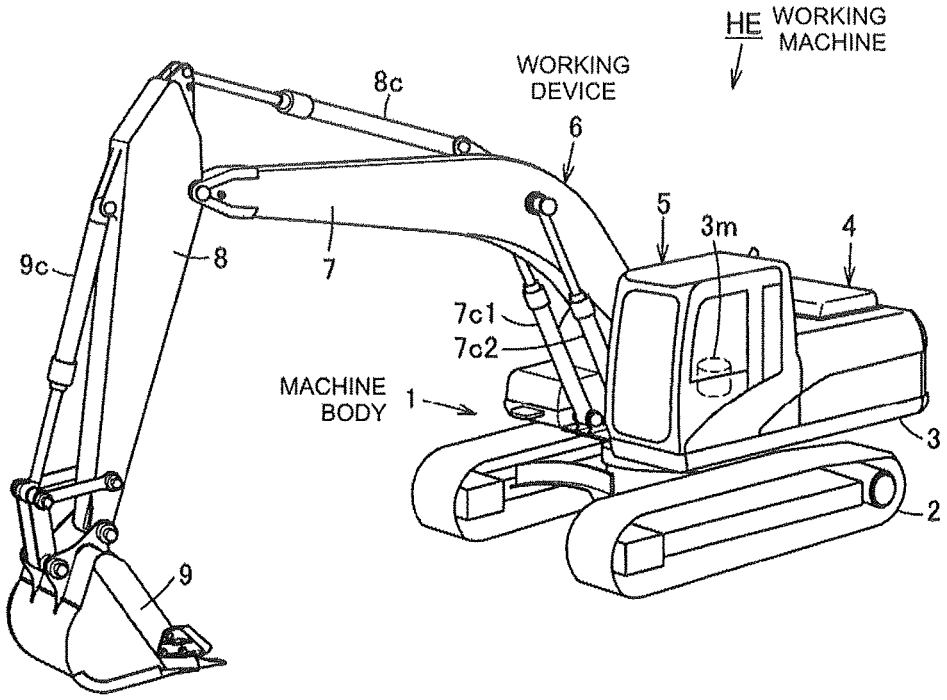
FIG. 11 is a perspective view showing a working machine provided with this hydraulic circuit.

As shown in FIG. 11, a hydraulic excavator HE, which is a working machine, has a machine body 1 that is configured by a lower traveling body 2 and an upper slewing body 3 provided thereon so as to be slewable by a slewing motor 3*m*, wherein the upper slewing body 3 is equipped with a machine room 4 equipped with the engine, a pump and the like, a cab 5 for protecting an operator, and a working device 6.

In this working device 6, a base end of a boom 7 that is rotated vertically by two parallel boom cylinders 7*c*1, 7*c*2 functioning as hydraulic cylinders is axially supported on the upper slewing body 3, a stick 8 that is rotated back and forth by a stick cylinder 8*c* is axially supported at a tip of the boom 7, and a bucket 9 that is rotated by a bucket cylinder 9*c* is axially supported at a tip of the stick 8. The two boom cylinders 7*c*1, 7*c*2 are provided parallel to the common boom 7 and simultaneously actuate the same operation.

Figure 1:
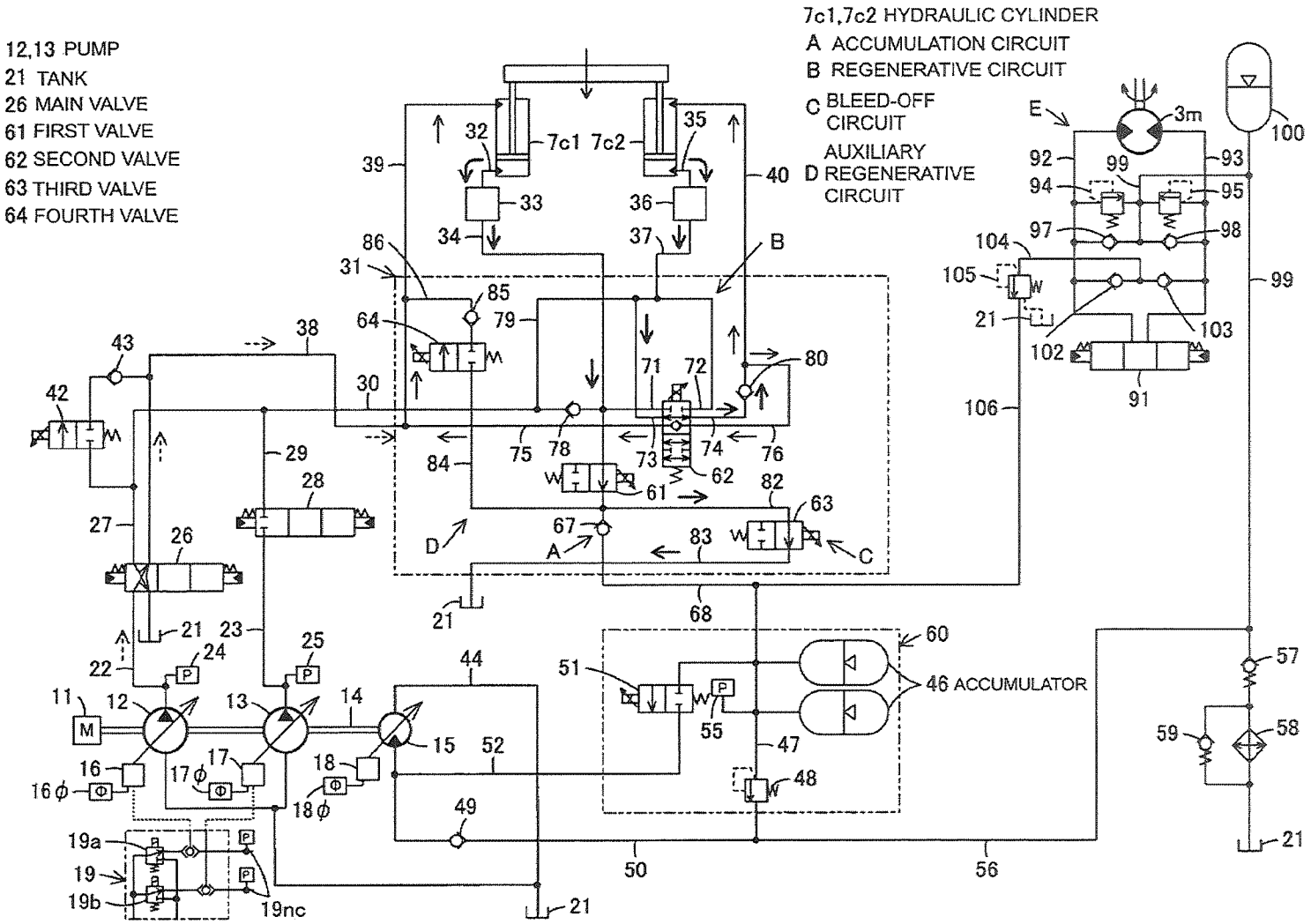
FIG. 1 is a circuit diagram showing a way of switching a hydraulic circuit according to an embodiment of the present invention.
Figure 2:
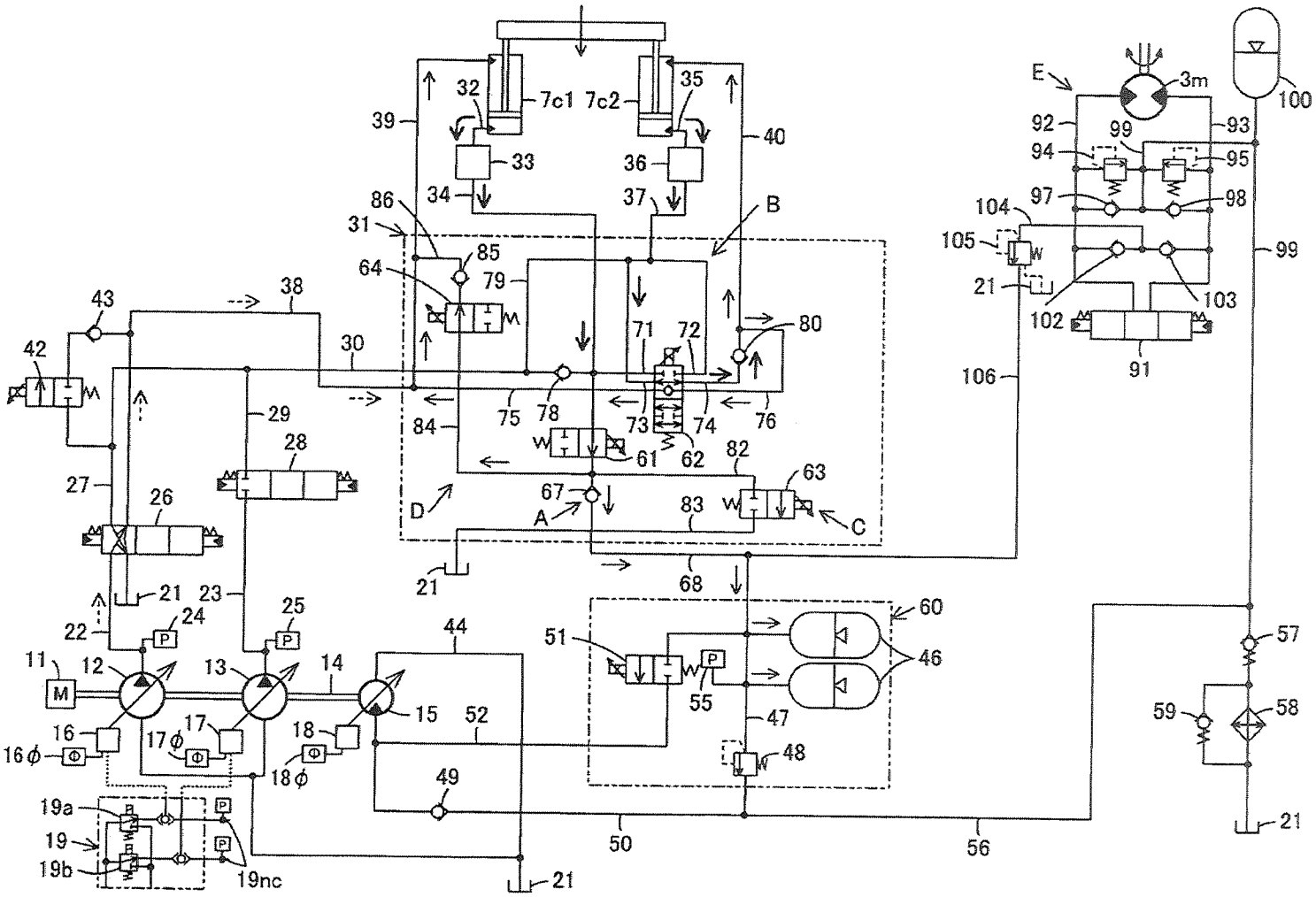
FIG. 2 is a circuit diagram showing another way of switching the circuit.
Figure 3:
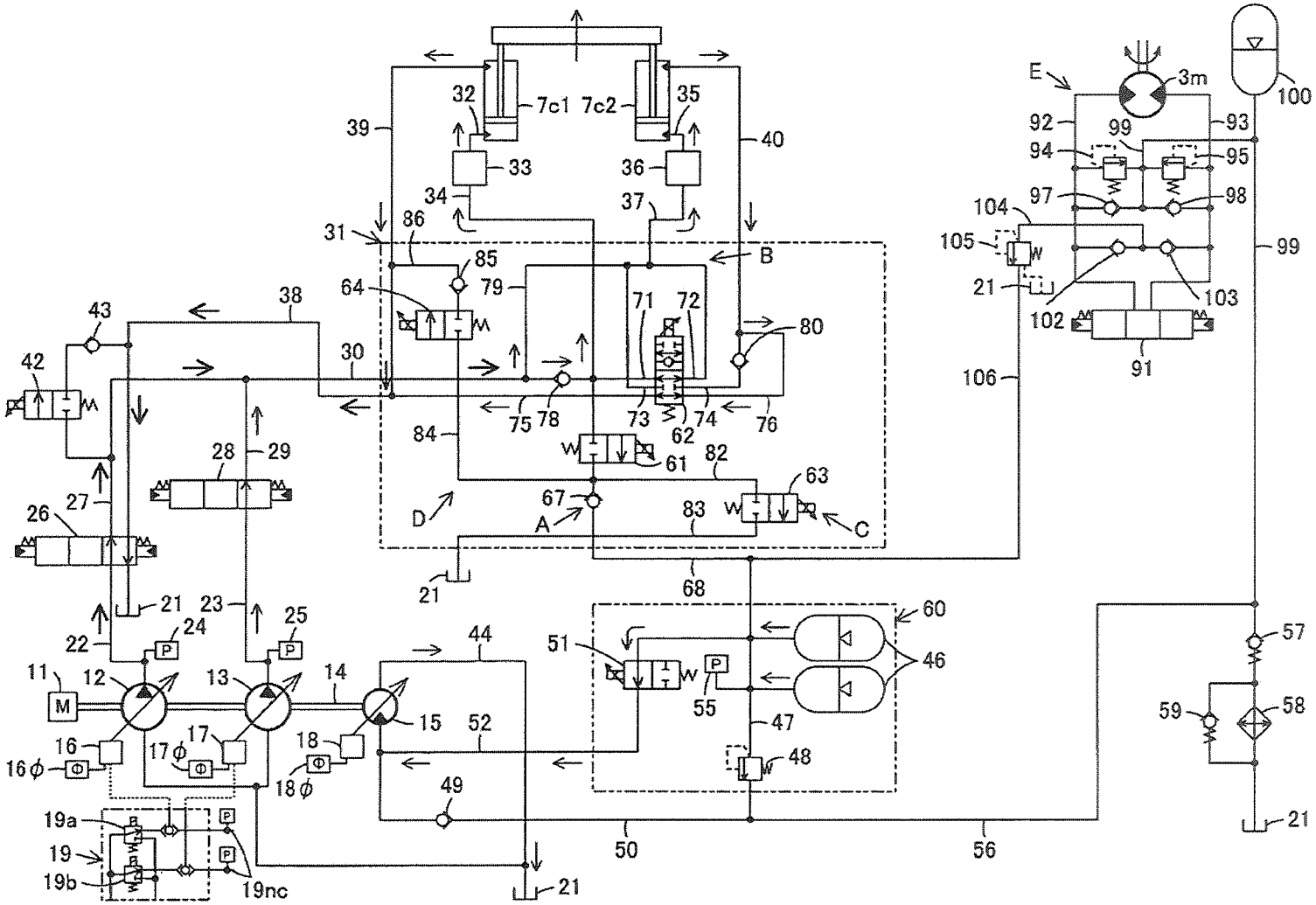
FIG. 3 is a circuit diagram showing yet another way of switching the circuit.

FIG. 1 to FIG. 3 each show an engine power assist system that accumulates position energy of the working device 6 in an accumulator through the boom cylinder 7*c*1, accumulates kinetic energy of the upper slewing body 3 in the accumulator through the slewing motor 3*m*, and uses these energies to assist engine power.

A circuit configuration of this system is described next.

An assist motor 15 is connected to a main pump shaft 14 of main pumps 12, 13 directly or by a gear, the main pumps 12, 13 being driven by a built-in engine 11 of the machine room 4. The main pumps 12, 13 and the assist motor 15 each have a swash plate capable of variably adjusting the pump/motor capacity (piston stroke) by the angle thereof. The swash plate angles (tilted angles) are controlled by regulators 16, 17, 18 and detected by swash plate angle sensors 16ϕ, 17ϕ, 18ϕ. The regulators 16, 17, 18 are controlled by a solenoid valve. For example, the regulators 16, 17 of the main pumps 12, 13 can be controlled automatically with a negative flow control pressure (so-called negative control pressure) guided through a negative flow control channel 19*nc* or with a signal other than the negative control pressure by solenoid switching valves 19*a*, 19*b* of a negative flow control valve 19 functioning as a flow rate control valve.

The main pumps 12, 13 discharge, to channels 22, 23, hydraulic oil which is a working fluid drawn up from a tank 21, and have the pump discharge pressures thereof detected by pressure sensors 24, 25. Pilot control valves for controlling the directions and flow rates of the hydraulic oil are connected to the main pumps 12, 13. The pilot control valves include a boom control valve 26 as a main valve for controlling the boom cylinders 7*c*1, 7*c*2 and a boom control valve 28 as a sub-valve. An output channel 27 extending from the boom control valve 26 and an output channel 29 extending from the boom control valve 28 are connected to a boom energy recovery valve 31, which is a composite valve, by a channel 30.

This boom energy recovery valve 31 is a composite valve that incorporates a plurality of circuit functions in a single block, the plurality of circuit functions being used for switching an accumulation circuit A, a regenerative circuit B, a bleed-off circuit C, an auxiliary regenerative circuit D, which are shown in FIG. 1 and FIG. 2, and a circuit that guides the hydraulic oil, which is pressurized and supplied by the main pumps 12, 13 in a boom lifting operation shown in FIG. 3, to heads of the two boom cylinders 7*c*1, 7*c*2.

A channel 32 extending from a head-side end of the boom cylinder 7*c*1 is connected to the boom energy recovery valve 31 by a channel 34 through a drift reduction valve 33, and a channel 35 extending from a head-side end of the boom cylinder 7*c*2 is connected to the boom energy recovery valve 31 by a channel 37 through a drift reduction valve 36. An output channel 38 extending from the main boom control valve 26 is connected to the regenerative circuit B of the boom energy recovery valve 31. The rods of the boom cylinders 7*c*1, 7*c*2 are connected to the boom energy recovery valve 31 by channels 39, 40. The drift reduction valves 33, 36 control the opening/closing and apertures between the ports by controlling the pilot pressure of a spring chamber by means of pilot valves, not shown.

The output channel 27 extending from the main boom control valve 26 can communicate with the output channel 38 by a solenoid switching valve 42 and a check valve 43.

The discharge side of the assist motor 15 is connected to the tank 21 by a discharge channel 44. A tank channel 50 extending from an accumulator channel 47 provided with a plurality of first accumulators 46 is connected to the suction side of the assist motor 15 through a relief valve 48 and a check valve 49, and a suction-side channel 52 extending from the accumulator channel 47 is connected to the same through a solenoid switching valve 51. A pressure sensor 55 for detecting pressure accumulated in the first accumulators 46 is connected to the accumulator channel 47. The tank channel 50 extends through a tank channel 56, a spring check valve 57, and an oil cooler 58 or a spring check valve 59 and is connected to the tank 21. The first accumulators 46, the accumulator channel 47, the relief valve 48, the solenoid switching valve 51, and the pressure sensor 55 are incorporated in the single block to configure an accumulator block 60.

The boom energy recovery valve 31 has a control valve 61 that is a first valve configuring a part of the accumulation circuit A, a main control valve 62 that is a second valve functioning as a boom circuit switching valve to configure a part of the regenerative circuit B, a bleed-off valve 63 that is a third valve configuring a part of the bleed-off circuit C, and a regeneration control valve 64 that is a fourth valve configuring a part of the auxiliary regenerative circuit D. Pilot-operated valves are used as these valves 61 to 64, the pilot-operated valves being switched when the solenoid switching valves are operated by, for example, the operator in the cab 5 (FIG. 11) or the like operating an operating device such as a lever, not shown, to control the supply and discharge of the pilot pressure. However, for the purpose of clarifying the explanation, the control valves 61 to 64 are shown as solenoid proportional direction control valves in the diagrams.

The control valve 61 is a flow rate control valve that allows the hydraulic oil from the boom cylinder 7*c*1 to be accumulated in the first accumulators 46, by switching between enabling and blocking the communication between the channels 68 and 34 connected to the first accumulators 46 (the accumulator block 60) through a check valve 67. The control valve 61 allows the hydraulic oil to flow in an amount larger than the amount of hydraulic oil returned from the normal cylinders (boom cylinders 7*c*1, 7*c*2 and the like) to the tank 21, and prioritizes accumulation of pressure oil in the first accumulators 46.

The main control valve 62 separates the boom cylinder 7*c*1 and the boom cylinder 7*c*2 into an accumulation cylinder and a self-regenerative cylinder by switching the relationship between channels 71 and 72, the relationship between channels 73 and 74, and the relationship between channels 75 and 76. Specifically, the main control valve 62 is configured to block the communication between the heads of the boom cylinders 7*c*1, 7*c*2 and enables the communication between the head of the boom cylinder 7*c*2 and the rods of the boom cylinders 7*c*1, 7*c*2 at the time of accumulation in the first accumulators 46 by switching the control valve 61.

The channel 30 is connected to the channel 71 through a check valve 78. The channel 72 is connected to the channel 37 and a channel 79 branching off from the channel 30. The channel 73 branches off from the channel 72. The channel 74 is connected to the channel 40 through a check valve 80. The channel 75 is connected to the output channel 38 and the channel 39, and the channel 76 branches off from the channel 40.

The bleed-off valve 63 is for switching the relationship between a channel 82 and a channel 83, the channel 82 branching off from the upstream side of the check valve 67 with respect to the control valve 61, i.e., the channel 68, and the channel 83 communicating with the tank 21. Operated in conjunction with the control valve 61, this bleed-off valve 63 is configured to enable the communication between the control valve 61 and the tank 21 in the initial stage of switching the control valve 61, and to block the communication between the control valve 61 and the tank 21 during the switching of the control valve 61 based on a predetermined condition such as after a lapse of a predetermined short time period (e.g., 0.5 seconds) since the initial stage.

The regeneration control valve 64 is a flow rate control valve that regenerates some (approximately half) of the hydraulic oil, which is discharged from the head of the boom cylinder 7*c*1 to the first accumulators 46 through the control valve 61, to the rod of the boom cylinder 7*c*1, by switching between enabling and blocking the communication between a channel 84 branching off from the upstream side of the check valve 67 with respect to the control valve 61, i.e., the channel 68, and a channel 86 that extends through a check valve 85 and is connected to the channel 39, i.e., the rod of the boom cylinder 7*c*1. Operated in conjunction with the control valve 61, this regeneration control valve 64 enables the communication between the control valve 61 and the head of the boom cylinder 7*c*1 when accumulating the hydraulic oil in the first accumulators 46 by switching the control valve 61, and blocks the communication between the control valve 61 and the head of the boom cylinder 7*c*1 when blocking the communication between the head of the boom cylinder 7*c*1 and the first accumulators 46 by switching the control valve 61.

As shown in FIG. 2, the accumulation circuit A is a circuit where the hydraulic oil flows from the channel 32 extending from the head-side end of the boom cylinder 7*c*1, passes through the drift reduction valve 33, the channel 34, the control valve 61 and check valve 67 of the boom energy recovery valve 31, and the channel 68, and reaches the first accumulators 46. The accumulation circuit A functions to accumulate in the first accumulators 46 some (approximately half) of the hydraulic oil ejected from the head of the boom cylinder 7*c*1.

The regenerative circuit B is a circuit where the hydraulic oil flows from the channel 35 extending from the head-side end of the boom cylinder 7*c*2, passes through the drift reduction valve 36, the channel 37, the channel 73, main control valve 62, channel 74, check valve 80, and channel 40 of the boom energy recovery valve 31, reaches the rod-side end of the boom cylinder 7*c*2, flows again from the channel 35, passes through the drift reduction valve 36, the channel 37, the channel 73, main control valve 62, channel 74, check valve 80, channel 76, main control valve 62, channel 75, and channel 39 in the boom energy recovery valve 31, and then reaches the rod-side end of the boom cylinder 7*c*1. The regenerative circuit B functions to regenerate, to the rods of the boom cylinders 7*c*1, 7*c*2, the hydraulic oil ejected from the head of the boom cylinder 7*c*2.

The bleed-off circuit C is a circuit branching off from the accumulation circuit A, in which the hydraulic oil reaches the tank 21 through the control valve 61, channel 82, bleed-off valve 63, and channel 83 of the boom energy recovery valve 31. The bleed-off circuit C functions to return the hydraulic oil, which is ejected from the head of the boom cylinder 7*c*1, to the tank 21 at initial operation of the control valve 61, or in other words in the initial stage of contraction of the boom cylinders 7*c*1, 7*c*2 or the initial stage of a boom lowering operation.

As shown in FIG. 1, the auxiliary regenerative circuit D is a circuit branching off from the accumulation circuit A, in which the hydraulic oil flows from the channel 32 extending from the head-side end of the boom cylinder 7*c*1, passes through the drift reduction valve 33, the channel 34, the control valve 61, channel 84, regeneration control valve 64, check valve 85, and channel 86 of the boom energy recovery valve 31, and reaches the rod-side end of the boom cylinder 7*c*1 through the channel 39. The auxiliary regenerative circuit D functions to regenerate, to the rod of the boom cylinder 7*c*1, some of the hydraulic oil ejected from the head of the boom cylinder 7*c*1, except for some of which to be accumulated in the first accumulators 46.

Relief valves 94, 95 and check valves 97, 98 that are mutually opposite to each other are provided between channels 92, 93 of a motor drive circuit E that connects a slewing control valve 91 and the slewing motor 3*m* to each other, the slewing control valve 91 controlling the slewing direction and speed of the slewing motor 3*m*. A makeup channel 99, which has a tank channel function for returning the oil discharged from the motor drive circuit E to the tank 21 and a makeup function capable of replenishing the motor drive circuit E with hydraulic oil, is connected between the relief valves 94, 95 and between the check valves 97, 98. The makeup channel 99 is connected to a second accumulator 100 that supplies pressure oil: Hydraulic oil is replenished in the channel 92 or 93, whichever is likely to cause a vacuum, from the makeup channel 99 through the check valves 97, 98 at a pressure that does not exceed the spring biasing force of the spring check valve 57.

The channels 92, 93 of the motor drive circuit E are made to communicate with a slewing energy recovery channel 104 by check valves 102, 103. This channel 104 is connected to a channel 106 through a sequence valve 105 where the source pressure at the inlet thereof does not change easily due to the back pressure at the outlet of the same. The channel 106 is connected to the first accumulators 46 and the channel 68.

In the foregoing circuit configuration, the swash plate angle sensors 16ϕ, 17ϕ, 18ϕ and the pressure sensors 24, 25, 55 input the detected swash plate angle signals and pressure signals to an in-vehicle controller (not shown), and the valves 42, 51 are switched by an on/off operation using a drive signal output form the in-vehicle controller (not shown) or a proportional action in accordance with the drive signal. The boom control valves 26, 28, the slewing control valve 91, and other hydraulic actuator control valves that are not shown (such as a travel motor control valve, a stick cylinder control valve, a bucket cylinder control valve and the like) are pilot-operated by a manually operated valve which is a so-called remote-control valve operated by the operator in the cab 5 (FIG. 11) or the like operating the lever or pedal. The pilot valves of the drift reduction valves 33, 36, which are not shown, are also pilot-operated in conjunction with the foregoing valves.

The details controlled by the in-vehicle controller are described functionally hereinafter.

FIG. 1 and FIG. 2 each show a state of the circuit in which the boom lowering operation for lowering the boom 7 (FIG. 11) is performed. The hydraulic oil that is ejected from the head of the boom cylinder 7*c*1 due to a load or the like of the working device 6 (FIG. 11) passes through the channel 32, the drift reduction valve 33, and the channel 34, and is returned from the control valve 61 of the boom energy recovery valve 31 that is switched to the communication position, to the tank 21 (FIG. 1) by the bleed-off valve 63 switched to the communication position in the initial stage. The hydraulic oil is further made to communicate with the channel 68 and channel 84 from the control valve 61 through the check valve 67 when the bleed-off valve 63 is switched to the blocking position based on a predetermined condition such as a lapse of a predetermined time period. From the channel 68, the hydraulic oil is then accumulated in the first accumulators 46, passes through the channel 84 and the regeneration control valve 64 switched to the communication position, and is regenerated to the rod of the boom cylinder 7*c*1 through the check valve 85, the channel 86, and the channel 39 (FIG. 2).

In this state, the control valve 61 switches the amount of communication between the head of the boom cylinder 7*c*1 and the first accumulators 46, in accordance with the operation amount of the lever, i.e., the pilot pressure set based on this operation amount, and the accumulator pressure of the first accumulators 46 detected by the pressure sensor 55. Specifically, the pilot pressure that is set based on the operation amount of the lever is corrected based on a predetermined table (converter) T1, and the accumulator pressure is corrected based on a predetermined table (converter) T2. Then, the result obtained by integrating these corrected values is obtained as an output for operating the control valve 61. More specifically, in the present embodiment, in the table T1 shown in FIG. 4, when the pilot pressure that is set based on the operation amount of the lever is relatively small, the amount of increase in the output pressure thereof becomes relatively greater than the amount of increase in the input pressure of the same. Therefore, in the region where the pilot pressure that is set based on the operation amount of the lever exceeds a predetermined threshold TH1, the amount of increase in the output pressure with respect to the amount of increase in the input pressure is reduced more compared to when the pilot pressure is equal to or lower than the threshold TH1. Furthermore, in the region where the pilot pressure exceeds a predetermined threshold TH2 that is greater than the predetermined threshold TH1, the output pressure is set constant. Furthermore, according to the table T2, in the region where the accumulator pressure is equal to or lower than a predetermined threshold TH3, a gain increases with respect to the amount of increase in the accumulator pressure, and in the region where the accumulator pressure exceeds the predetermined threshold TH3, the gain is set constant (e.g., 1). In this case, the hydraulic oil is prevented by the check valve 78 from returning toward the boom control valve 26.

Figure 6:
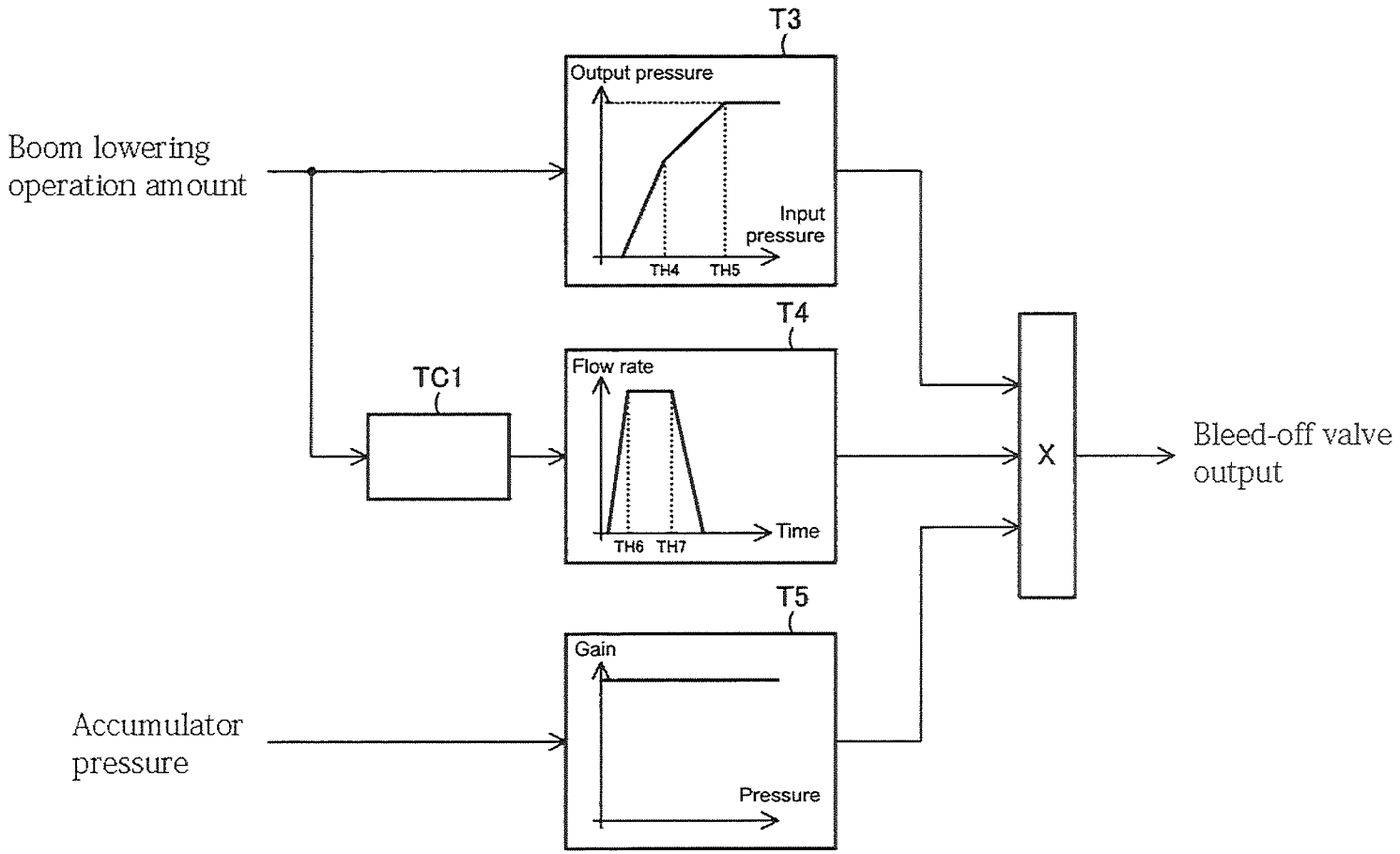
FIG. 6 is an explanatory diagram schematically showing a control algorithm of a third valve of the circuit.
Figure 7:
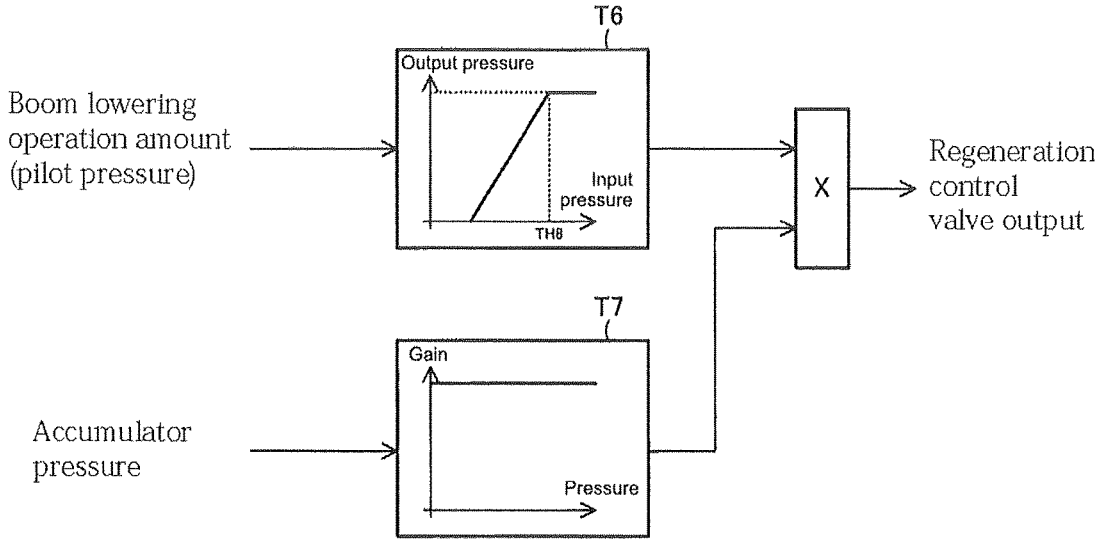
FIG. 7 is an explanatory diagram schematically showing a control algorithm of a fourth valve of the circuit.

The bleed-off valve 63 switches the amount of communication between the control valve 61 and the tank 21, in accordance with the operation amount of the lever, i.e., the pilot pressure set based on this operation amount, and the accumulator pressure of the first accumulators 46 detected by the pressure sensor 55. Specifically, as shown in FIG. 6, a base pressure, which is set based on a predetermined table (converter) T3 in accordance with the pilot pressure that is set based on the operation amount of the lever, a gain, which is set based on a predetermined table (converter) T4 for accelerating the lowering of the boom in accordance with a predetermined short time period at the start of the boom lowering operation that is measured by a time counter TC1, such as a lapse of 10 ms, and a gain that is set based on a predetermined table (converter) T5 in accordance with the accumulator pressure, are integrated together, and this resultant integrated value is obtained as an output for operating the bleed-off valve 63. According to the table T3, in the region where the pilot pressure that is set based on the operation amount of the lever is equal to or lower than a predetermined threshold TH4, the amount of increase in the output pressure becomes relatively greater than the amount of increase in the pilot pressure. In the region where the pilot pressure exceeds the predetermined threshold TH4, the amount of increase in the output pressure with respect to the amount of increase in the input pressure is reduced more compared to when the pilot pressure is equal to or lower than the threshold TH4. In the region where the pilot pressure exceeds a predetermined threshold TH5 greater than the predetermined threshold TH4, the output pressure is set constant. In the table T4, the gain increases as time measured by the time counter TC1 passes, and between the time where the pilot pressure exceeds a predetermined threshold TH6 and the time where the pilot pressure is equal to or lower than a predetermined threshold TH7 greater than the predetermined threshold TH6, the gain is set constant. For a predetermined time period after the predetermined threshold TH7, such as for 0.5 ms, the gain decreases as time passes.

In the table T5, the gain is set constant with respect to the amount of increase in the accumulator pressure.

The regeneration control valve 64 switches the amount of communication between the control valve 61 and the rod of the boom cylinder 7*c*1, in accordance with the operation amount of the lever, i.e., the pilot pressure set based on this operation amount, and the accumulator pressure of the first accumulators 46 detected by the pressure sensor 55. Specifically, the pilot pressure that is set based on the operation amount of the lever is corrected based on a predetermined table (converter) T6, and the accumulator pressure is corrected based on a predetermined table (converter) T7. Then, the result obtained by integrating these corrected values is obtained as an output for operating the regeneration control valve 64. More specifically, in the present embodiment, in the table T6 shown in FIG. 7, when the pilot pressure that is set based on the operation amount of the lever is relatively small, the output pressure thereof increases in proportion to an increase in the input pressure of the same. Therefore, in the region where the pilot pressure set based on the operation amount of the lever exceeds a predetermined threshold TH8, the output pressure is set constant. Furthermore, in the table T7, the gain is set constant with respect to the amount of increase in the accumulator pressure.

Figure 4:
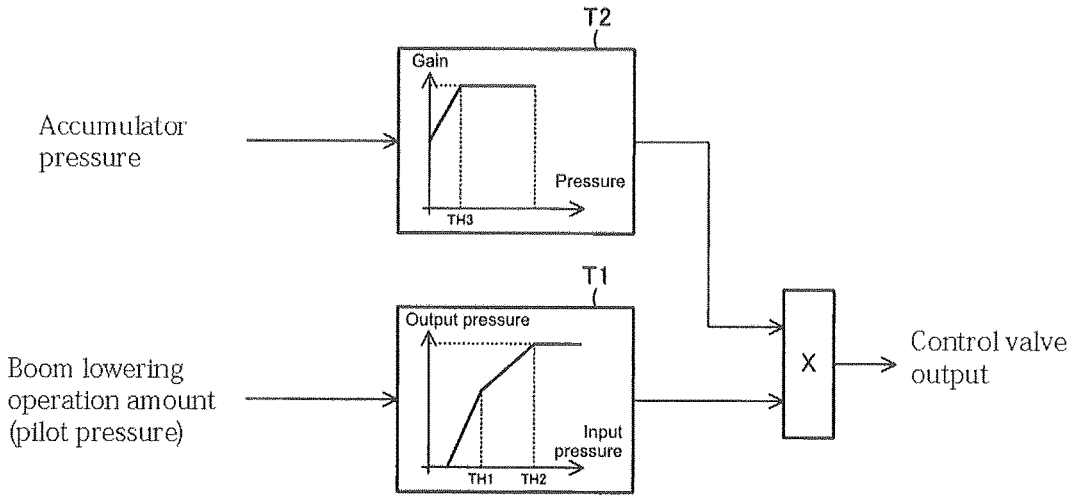
FIG. 4 is an explanatory diagram schematically showing a control algorithm of a first valve of the circuit.
Figure 5:
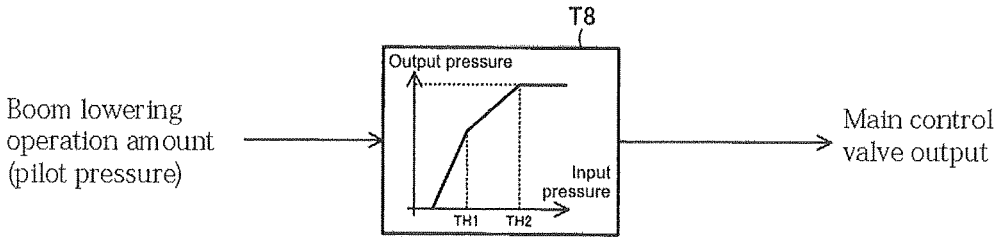
FIG. 5 is an explanatory diagram schematically showing a control algorithm of a second valve of the circuit.

At the same time, the direction of the hydraulic oil ejected from the head of the boom cylinder 7*c*2 is controlled to allow the hydraulic oil to flow toward the channel 74 through the channel 35, the drift reduction valve 36, the channel 37, the main control valve 62 of the boom energy recovery valve 31, and the channel 73. The hydraulic oil further passes through the check valve 80 and the channel 40 and is regenerated to the rod of the boom cylinder 7*c*2. Then, the direction of the hydraulic oil branching off to the channel 76 through the check valve 80 is controlled to allow the hydraulic oil to flow to the channel 75 through the check valve inside the main control valve 62. Consequently, the hydraulic oil passes through the channel 39 and is regenerated to the rod of the boom cylinder 7*c*1. At this moment, the operation amount of the main control valve 62 changes in response to the operation amount of the lever, i.e., the pilot pressure that is set based on this operation amount. Specifically, the pilot pressure that is set based on the operation amount of the lever is corrected based on a predetermined table (converter) T8, and the resultant pressure is taken as an output for operating the main control valve 62. More specifically, in the present embodiment, the table T8 similar to the table T1 shown in FIG. 4 is used to set the input pressure and the output pressure of the pilot pressure that is set based on the operation amount of the lever, as shown in FIG. 5, and basically the main control valve 62 is switched as soon as the boom lowering operation is detected. Note that an excess flow rate of the hydraulic oil ejected from the head of the boom cylinder 7*c*2 is returned from the boom control valve 26 to the tank 21 after passing through the channel 37, the channel 79, and the channel 30. In addition, for example, in a case where grounding of the working device 6 (FIG. 11) is detected based on the head pressure of the boom cylinders 7*c*1,7*c*2 and thereby it is detected that lowering of the boom results in lifting of the machine body 1, separation of the boom cylinders 7*c*1, 7*c*2 into the accumulation cylinder and the self-regenerative cylinder is canceled in accordance with a predetermined set value.

Using the control valve 61, the regeneration control valve 64 and the main control valve 62, the boom energy recovery valve 31 accumulates the hydraulic oil in the first accumulators 46 at the time of lowering the boom and at the same time regenerates the hydraulic oil to the rods of the boom cylinders 7*c*1, 7*c*2.

Some of the hydraulic oil discharged from the main pump 12 at the time of the boom lowering operation is supplied to the rod of the boom cylinder 7*c*1 from the boom control valve 26 through the output channel 38 and the channel 39. At this moment, only at the start of the boom lowering operation where the bleed-off valve 63 is in the communication position and thereby the hydraulic oil, which is ejected from the head of the boom cylinder 7*c*1, is returned to the tank 21 from the bleed-off circuit C through the control valve 61, the boom control valve 26 supplies the hydraulic oil to the rod of the boom cylinder 7*c*1 through the output channel 38 and the channel 39 at the maximum flow rate, in conjunction with the bleed-off valve 63. And when the bleed-off valve 63 is in the blocking position and thereby the boom 7 starts to descend, the hydraulic oil from the head of the boom cylinder 7*c*2 is regenerated to the rods of the boom cylinders 7*c*1, 7*c*2, thereby restricting the flow rate.

Figure 8:
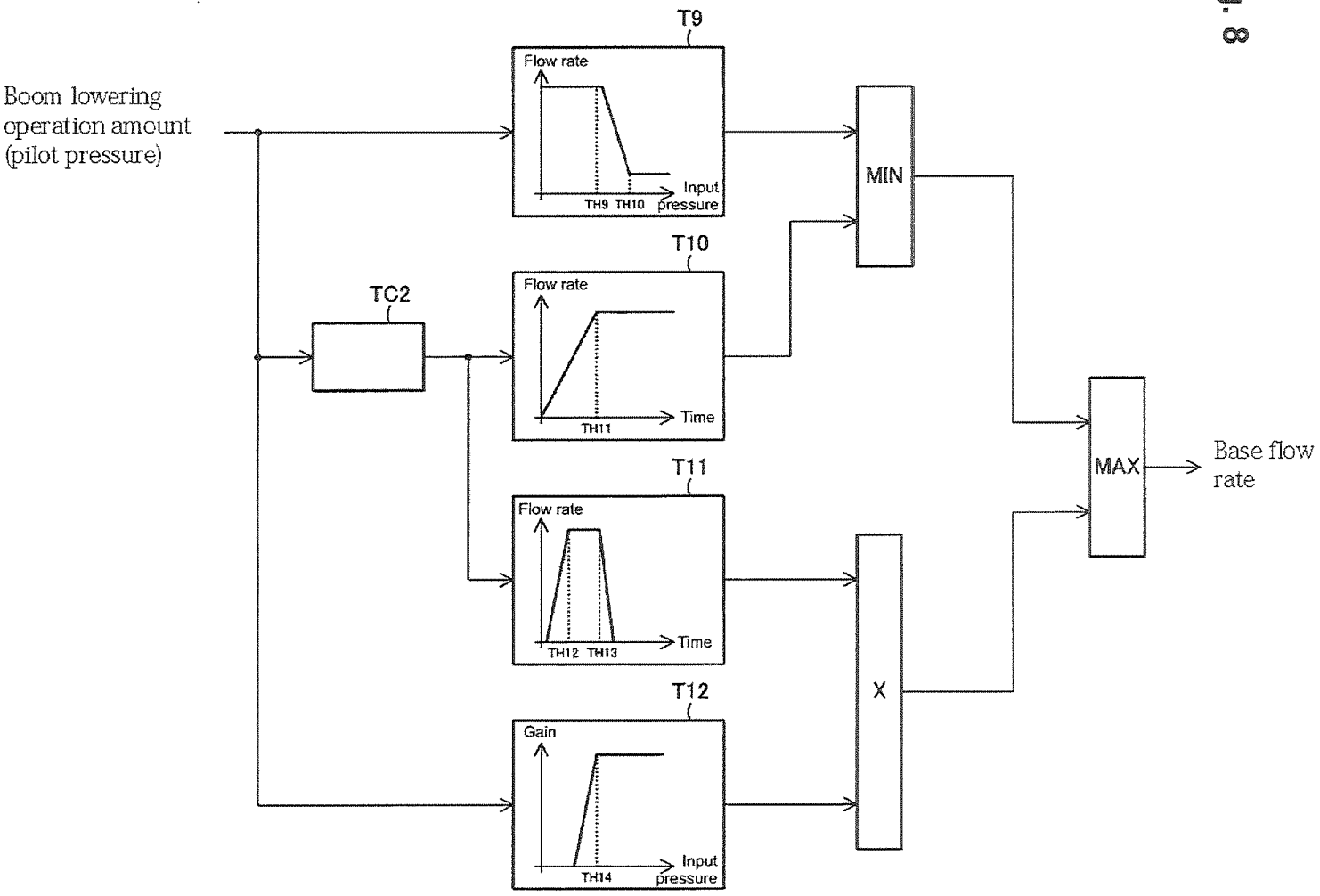
FIG. 8 is an explanatory diagram schematically showing a part of a flow rate control algorithm of a pump of the circuit.

The pump flow rate from the main pump 12 controlled by the boom control valve 26 to the boom cylinder 7*c*1 is set by the solenoid switching valve 19*a* of the negative flow control valve 19 in accordance with the operation amount of the lever, i.e., the pilot pressure that is set based on this operation amount, and the accumulator pressure of the first accumulators 46. Specifically, in the present embodiment, as shown in FIG. 8, the base flow rate of this pump flow rate is set as follows. In other words, the minimum value of a flow rate that is set based on a predetermined table (converter) T9 in accordance with the pilot pressure set based on the operation amount of the lever is obtained, as well as the minimum value of a flow rate that is set based on a predetermined table (converter) T10 in accordance with a predetermined short time period at the start of the boom lowering operation that is measured by a time counter TC2, such as a lapse of 10 ms. Then, an accelerated flow rate that is set based on a predetermined table (converter) T11 in accordance with a predetermined short time period at the start of the boom lowering operation that is measured by the time counter TC2, such as a lapse of 10 ms, is integrated with a gain that is set based on a predetermined table (converter) T12 in accordance with the pilot pressure that is set based on the operation amount of the lever. The foregoing minimum values or the resultant integrated value, whichever is bigger, is set as the base flow rate. In the table T9, the flow rate is set constant in the region where the pilot pressure that is set based on the operation amount of the lever is equal to or lower than a predetermined threshold TH9. However, in the region where the pilot pressure exceeds the predetermined threshold TH9 but is equal to or lower than a predetermined threshold TH10 that is greater than the predetermined threshold TH9, the flow rate decreases in proportion to an increase in the pilot pressure. Thus, the flow rate is set constant in the region where the pilot pressure exceeds the predetermined threshold TH10. According to the table T10, the flow rate increases as time measured by the time counter TC2 passes, and the flow rate is set constant from the time where the pilot pressure exceeds a predetermined threshold TH11. According to the table T11, the flow rate increases as time measured by the time counter TC2 passes, and then the flow rate is set constant between the time where the pilot pressure exceeds a predetermined threshold TH12 and the time where the pilot pressure is equal to or lower than a predetermined threshold TH13 that is greater than the predetermined threshold TH12. From the time where the pilot pressure exceeds the predetermined threshold TH13, the flow rate decreases as time passes. According to the table T12, when the pilot pressure that is set based on the operation amount of the lever is relatively small, the gain increases in proportion to an increase in the pilot pressure, and the gain is set constant (e.g., 1) in the region where the pilot pressure exceeds a predetermined threshold TH14.

Figure 9:
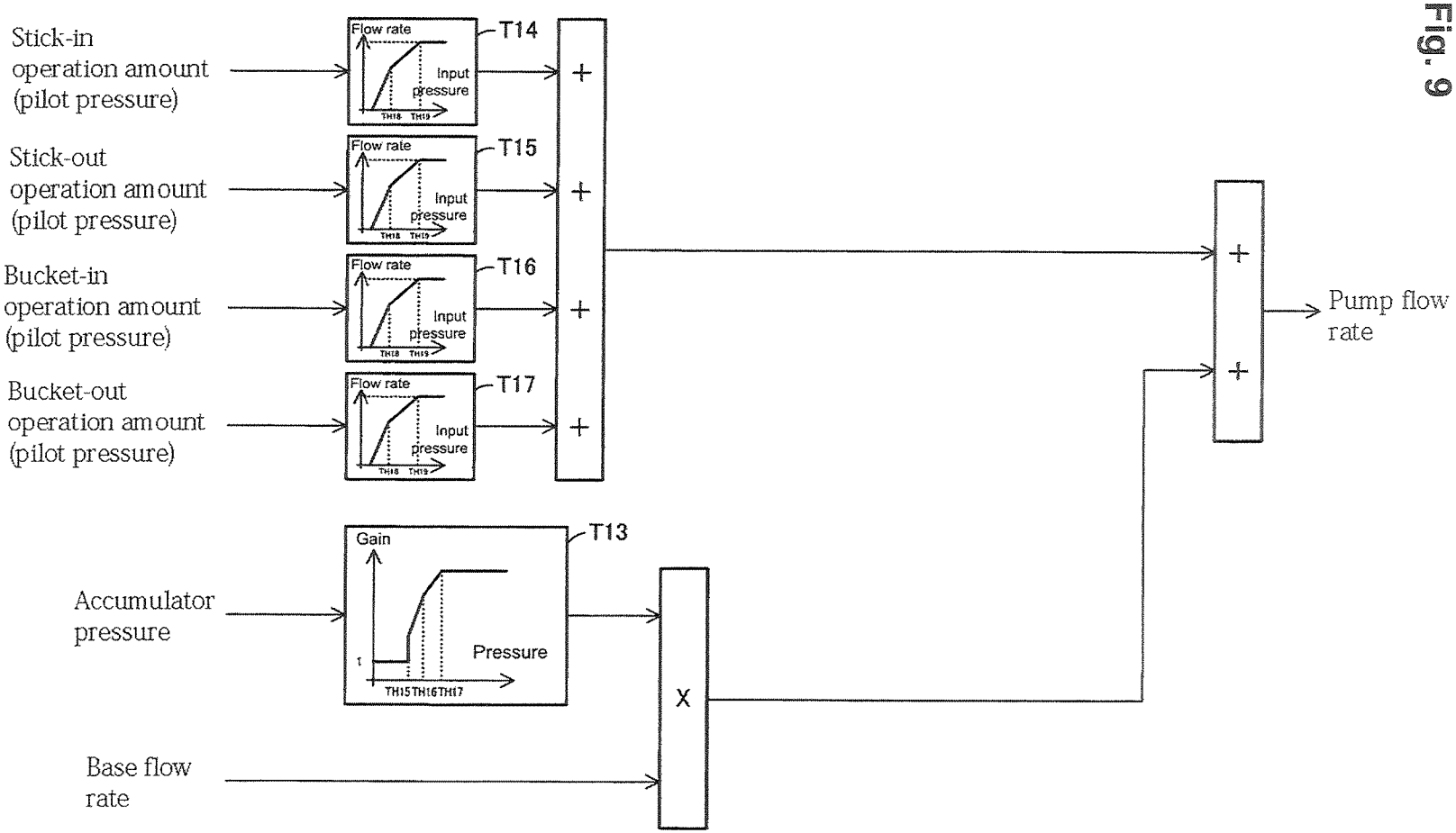
FIG. 9 is an explanatory diagram schematically showing another part of the flow rate control algorithm of the pump of the circuit.

As shown in FIG. 9, a flow rate that is obtained by integrating the base flow rate described above with a gain that is set based on the predetermined table (converter) T13 in accordance with the accumulator pressure, is set as the foregoing pump flow rate for the boom lowering operation alone. When a lever operation such as a stick-in operation, a stick-out operation, a bucket-in operation, or a bucket-out operation is performed simultaneously with the boom lowering operation, flow rates that are set based on predetermined tables (converters) T14 to T17 in accordance with the pilot pressures set based on these operations are added up. In the table T13, the gain is set constant (e.g., 1) when the accumulator pressure is equal to or lower than a predetermined threshold TH15. In the region where the accumulator pressure exceeds the predetermined threshold TH15, when the accumulator pressure is relatively small, the amount of increase in the gain is relatively greater than the amount of increase in the accumulator pressure. In the region where the accumulator pressure exceeds the predetermined threshold TH15 but is equal to or lower than a predetermined threshold TH16 that is greater than the predetermined threshold TH15, the amount of increase in the gain with respect to the amount of increase in the accumulator pressure is reduced more compared to when the accumulator pressure is equal to or lower than the threshold TH15. Furthermore, in the region where the accumulator pressure exceeds a predetermined threshold TH17 that is greater than the predetermined threshold TH16, the gain is set constant (greater than 1). In each of the tables T14 to T17, in the region where the pilot pressure set by the operation amount of the lever is equal to or lower than a predetermined threshold TH18, the amount of increase in the flow rate is relatively greater than the amount of increase in the pilot pressure, and in the region where the pilot pressure exceeds the predetermined threshold TH18 but is equal to or lower than a predetermined threshold TH19 that is greater than the predetermined threshold TH18, the amount of increase in the flow rate with respect to the amount of increase in the pilot pressure is reduced more compared to when the pilot pressure is equal to or lower than the threshold TH18. Furthermore, in the region where the pilot pressure exceeds the predetermined threshold TH19, the flow rate is set constant. These tables T14 to T17 may be identical or have the values of the thresholds TH18 and TH19 different from each other.

FIG. 3 shows a state of the circuit in which the boom lifting operation for raising the boom 7 (FIG. 11) is performed. In the boom lifting operation, the boom energy recovery valve 31 not only switches the control valve 61 and the regeneration control valve 64 to the blocking position but also switches the main control valve 62 to stop the accumulation of the hydraulic oil in the first accumulators 46 and the regeneration of the same to the rods of the boom cylinders 7*c*1, 7*c*2. The boom energy recovery valve 31 also guides the hydraulic oil, which is supplied from the main pumps 12, 13 to the channel 30 through the boom control valves 26, 28, from the channel 79 to the head of the boom cylinder 7*c*2 through the channel 37, the drift reduction valve 36, and the channel 35, and further guides the hydraulic oil from the check valve 78 to the head of the boom cylinder 7*c*1 through the channel 34, the drift reduction valve 33, and the channel 32. The hydraulic oil ejected from the rod of the boom cylinder 7*c*1 is returned to the tank 21 from the channel 39 and the output channel 38 through the boom control valve 26. The direction of the hydraulic oil ejected from the rod of the boom cylinder 7*c*2 is controlled to allow the hydraulic oil to flow to the channel 75 through the channel 40, the channel 76, and the main control valve 62, thereby returning the hydraulic oil to the tank 21 from the output channel 38 through the boom control valve 26.

In the boom lowering operation and the boom lifting operation, engine power assist can be performed in which the assist motor 15 with a motor function, which is coupled to the main pump shaft 14 directly or by a gear, is caused to function as a hydraulic motor as shown in FIG. 3, to reduce the engine load. For example, in the boom lowering operation, the engine power assist is performed when the pressure sensor 55 detects that the accumulator pressure of the first accumulators 46 that is accumulated through the control valve 61 is equal to or greater than a predetermined first threshold. Other than the boom lowering operation, such as in the boom lifting operation or the like, the engine power assist is performed when the pressure sensor 55 detects that the accumulator pressure of the first accumulators 46 is equal to or greater than a predetermined second threshold different from the predetermined first threshold. In this engine power assist, the solenoid switching valve 51 is switched to the communication position, and the assist motor 15 is rotated by the energy accumulated in the first accumulators 46, to assist the hydraulic outputs, of the main pumps 12, 13 and reduce the engine load. When the machine body 1 is lifted, the engine power assist is not performed using the assist motor 15.

Figure 10:
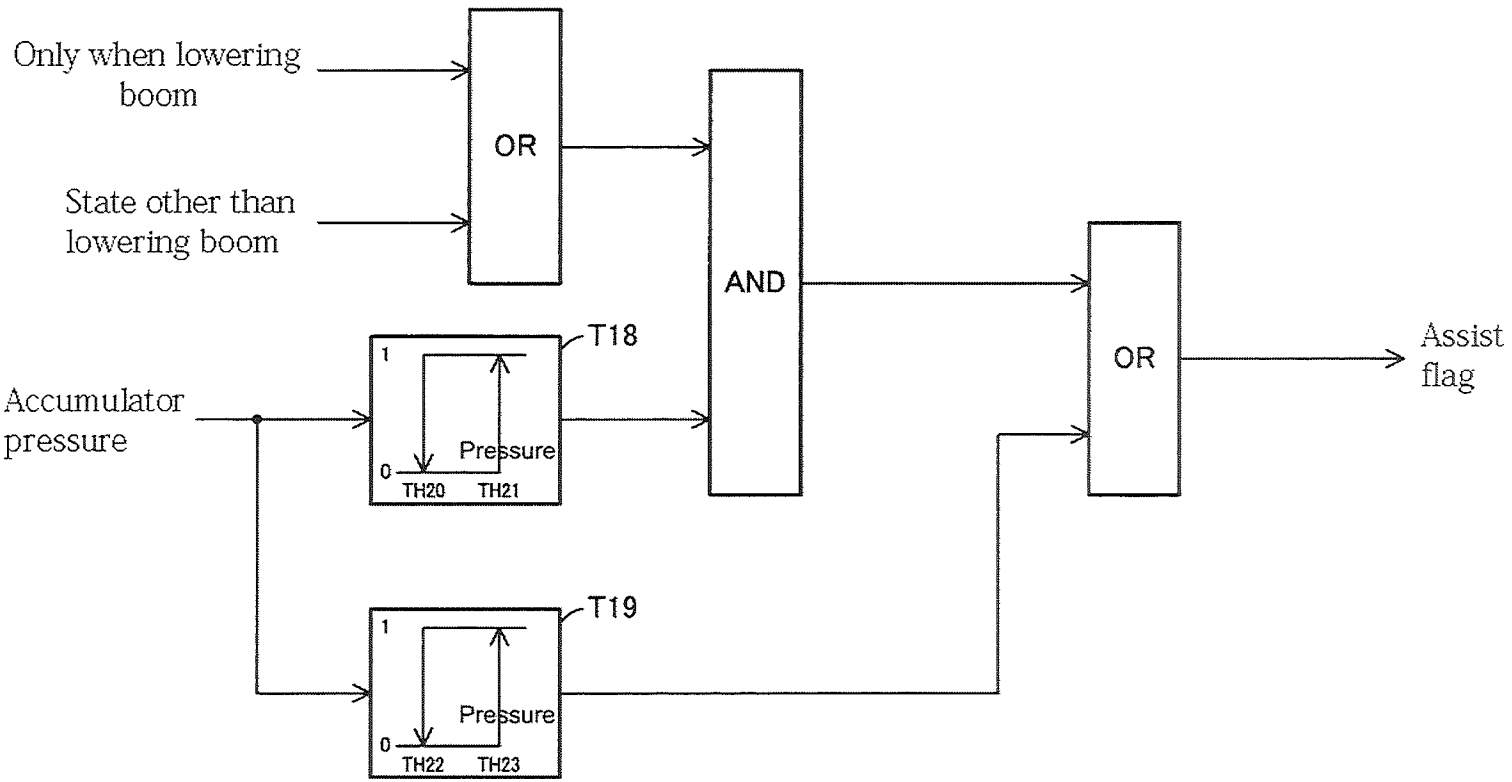
FIG. 10 is an explanatory diagram schematically showing a control algorithm of an engine power assist function of the circuit.

Specifically, as shown in FIG. 10, a logical sum of a logical product of flags that are set at 0 and 1 for the boom lowering operation (only when lowering the boom) and an operation other than the boom lowering operation (a state other than when lowering the boom) and a flag that is set according to the accumulator pressure based on a predetermined table (converter) T18 corresponding to the operation other than the boom lowering operation, and a flag that is set according to the accumulator pressure based on a predetermined table (converter) T19 corresponding to the boom lowering operation, is output. When this flag is ON or in other words 1, the solenoid switching valve 51 is switched to the communication position. When the assist flag is OFF or in other words 0, the solenoid switching valve 51 is switched to the blocking position. In the table T18 in which a predetermined threshold TH20 and a predetermined threshold TH21 greater than the predetermined threshold TH20 are set, the flag is switched from 0 to 1 when the accumulator pressure increases to become equal to or greater than the threshold TH21, and the flag is switched from 1 to 0 when the accumulator pressure decreases to become equal to or lower than the threshold TH20. In the table T19 in which a predetermined threshold TH22 greater than the predetermined threshold TH21 and a predetermined threshold TH23 greater than the predetermined threshold TH22 are set, the flag is switched from 0 to 1 when the accumulator pressure increases to become equal to or greater than the threshold TH23, and the flag is switched from 1 to 0 when the accumulator pressure decreases to become equal to or lower than the threshold TH22. These tables T18 and T19, therefore, each have so-called hysteresis in which the thresholds vary depending on the increase and decrease of the accumulator pressure.

Therefore, by rotating the assist motor 15 by means of the energy from the head of the boom cylinder 7*c*1 that is accumulated in the first accumulators 46, the engine power assist function reduces, by using the assist motor 15, the load of the built-in engine 11 that is coupled thereto by the main pump shaft 14.

As a result, when, for example, the boom lowering operation is executed, four sequences are established: a first sequence in which the control valve 61 is switched to the communication position and the main control valve 62 is switched to the position for blocking the communication between the heads of the boom cylinders 7*c*1, 7*c*2 and enabling the communication between the head of the boom cylinder 7*c*2 and the rods of the boom cylinders 7*c*1, 7*c*2, to form the accumulation circuit A and the regenerative circuit B; a second sequence (FIG. 1) following the first sequence, which is a short period of time in which the bleed-off valve 63 is switched to the communication position to return the hydraulic oil to the tank 21 through the bleed-off circuit C, and the hydraulic oil is supplied from the main pump 12 to the rod of the boom cylinder 7*c*1 by the boom control valve 26 to accelerate the contraction of the boom cylinders 7*c*1, 7*c*2, i.e., the lowering of the boom; a third sequence (FIG. 2) following the second sequence, in which the bleed-off valve 63 is switched to the blocking position to accumulate the hydraulic oil from the control valve 61 in the first accumulators 46, and some of the hydraulic oil to be accumulated in the first accumulators 46 is regenerated to the rod of the boom cylinder 7*c*1 by switching the regeneration control valve 64 to the communication position, and the supply of hydraulic oil to the rod of the boom cylinder 7*c*1 is minimized using the boom control valve 26; and a fourth sequence following the third sequence, in which, while accumulating the hydraulic oil in the first accumulators 46, the assist motor 15 is rotated using the accumulated excess energy.

In order to lower the working device 6 of the hydraulic excavator HE with the accumulation circuit A and the regenerative circuit B being separated from each other as described above, when some (approximately half) of the hydraulic oil ejected from the head of the boom cylinder 7*c*1 is accumulated in the first accumulators 46 through the control valve 61, the hydraulic oil is returned to the tank 21 through the bleed-off valve 63 of the bleed-off circuit C at initial operation of this control valve 61, and the hydraulic oil from the main pump 12 is supplied to the rod of the boom cylinder 7*c*1 through the boom control valve 26, improving the initial speed of contraction of the boom cylinders 7*c*1, 7*c*2. In other words, because connecting the head of the boom cylinder 7*c*1 to the first accumulators 46 by means of the accumulation circuit A leads to an increase of the back pressure, the contraction of the boom cylinders 7*c*1, 7*c*2 can easily be accelerated at initial operation by releasing the back pressure instantaneously through the bleed-off valve 63 of the bleed-off circuit C for a certain period of time.

Furthermore, because the hydraulic oil ejected from the head of the boom cylinder 7*c*2 is regenerated to the rods of the boom cylinders 7*c*1, 7*c*2 through the main control valve 62 at the same time as when the hydraulic oil is accumulated in the first accumulators 46, the regeneration flow rates of the main pumps 12, 13 at the time of the accumulation in the first accumulators 46 can be reduced, and the necessary pump flow rate including the main pump flow rates required by the other hydraulic actuators can easily be ensured with a simple configuration. Moreover, the size of the main pumps 12, 13 can be reduced.

In addition, because some of the hydraulic oil ejected from the head of the boom cylinder 7*c*1 is accumulated in the first accumulators 46 through the control valve 61 and the rest of the hydraulic oil is regenerated to the rod of the boom cylinder 7*c*1 through the regeneration control valve 64 of the auxiliary regenerative circuit D, the regeneration flow rate of the main pump 12 at the time of the accumulation in the first accumulators 46 can be further reduced, easily ensuring the necessary pump flow rate with a simple configuration.

Moreover, even in an simultaneous operation where the boom cylinders 7*c*1, 7*c*2 are operated in conjunction with the other hydraulic actuators (the slewing motor 3*m*, the stick cylinder 8*c*, the bucket cylinder 9*c*, and the like), some of the hydraulic oil ejected from the head of the boom cylinder 7*c*1 is regenerated to the rod of this boom cylinder 7*c*1 by the auxiliary regenerative circuit D, while the hydraulic oil ejected from the head of the boom cylinder 7*c*2 is regenerated to the rods of the boom cylinders 7*c*1, 7*c*2 by the same. Therefore, the amount of oil to be regenerated can be sent from the main pump 12, 13 to the other hydraulic actuators, preventing a reduction of the speed of the simultaneous operation and improving the operability of the simultaneous operation. In addition, such a configuration can effectively prevent a sudden descent of the boom 7 which is caused when the regeneration flow rates to the rods of the boom cylinders 7*c*1, 7*c*2 increases drastically at the time of stroke end of the other actuators.

In addition, because some of the oil from the head of the boom cylinder 7*c*1 is accumulated in the first accumulators 46, the load of the working device 6 is concentrated on the single boom cylinder 7*c*1 instead of being dispersed to the two boom cylinders 7*c*1, 7*c*2. As a result, the energy density can be increased, and the pressure generated from the boom cylinder 7*c*1 can be increased, resulting in an increase in the energy to be accumulated in the first accumulators 46. In other words, the sizes of the components such as the first accumulators 46 and the assist motor 15 can be reduced, resulting in a cost reduction and a simple layout of the circuit.

By causing the bleed-off valve 63 to change the amount of communication between the control valve 61 and the tank 21 in accordance with the operation amount of the lever and the accumulator pressure, the hydraulic oil ejected from the head of the boom cylinder 7*c*1 can be returned to the tank 21 effectively, improving the initial speed of contraction of the boom cylinders 7*c*1, 7*c*2 adequately.

Furthermore, the control valve 61 changes the amount of communication between the head of the boom cylinder 7*c*1 and the first accumulators 46 in accordance with the operation amount of the lever and the accumulator pressure of the first accumulators 46, and the regeneration control valve 64 changes the amount of communication between the control valve 61 and the rod of the boom cylinder 7*c*1 in accordance with the operation amount of the lever and the accumulator pressure. Thus, not only is it possible to accumulate the hydraulic oil in the first accumulators 46 more adequately without compromising the operability of the boom lowering operation, but also the operability and energy accumulation can be satisfied at the same time. In addition, the flow rate of the hydraulic oil discharged from the main pumps 12, 13 to the rod of the boom cylinder 7*c*1 can be reduced by effectively regenerating the hydraulic oil to the rod of the boom cylinder 7*c*1, ensuring the necessary pump flow rate more easily.

With the boom energy recovery valve 31 configured by integrating the plurality of circuit functions into a single block, not only is it possible to obtain a simple layout, but also a cost reduction can be achieved by reducing the number of assembly steps.

In addition, concentrating a load on the boom cylinder 7*c*1 alone can increase the energy to be accumulated in the first accumulators 46. Therefore, substantial assist can be performed with a small accumulator, resulting in a cost reduction and a compact machine body layout.

INDUSTRIAL APPLICABILITY

The present invention is industrially applicable to all businesses that are concerned in manufacturing and sales of hydraulic circuits or working machines.

What is claimed is:

1. A hydraulic circuit, comprising:

a first hydraulic cylinder and a second hydraulic cylinder that simultaneously actuate a same operation using a working fluid that is pressurized and supplied by a pump in response to an operation of an operating device;

an accumulator in which the working fluid is accumulated;

an accumulation circuit that is provided with a first valve for changing an amount of communication between a head of the first hydraulic cylinder and the accumulator in accordance with an operation amount of the operating device, and that accumulates the working fluid, which is ejected from the head of the first hydraulic cylinder, in the accumulator through the first valve;

a regenerative circuit that is provided with a second valve for blocking communication between the head of the first hydraulic cylinder and a head of the second hydraulic cylinder, and enabling communication between the head of the second hydraulic cylinder and rods of the first and second hydraulic cylinders when the accumulation circuit accumulates the working fluid in the accumulator, and that regenerates the working fluid, which is ejected from the head of the second hydraulic cylinder, to the first and second hydraulic cylinders through the second valve;

a bleed-off circuit that is provided with a third valve for switching between enabling and blocking communication between the first valve and a tank, and that returns the working fluid from the first valve to the tank through the third valve during an initial operation of the first valve; and a main valve that supplies the working fluid from the pump to the rod of the first hydraulic cylinder while the first valve and the tank communicate with each other by the third valve.

2. The hydraulic circuit according to claim 1, further comprising an auxiliary regenerative circuit that is provided with a fourth valve for changing an amount of communication between the first valve and the rod of the first hydraulic cylinder in accordance with the operation amount of the operating device, and that regenerates some of the working fluid, which is accumulated in the accumulator by the accumulation circuit, to the rod of the first hydraulic cylinder through the fourth valve while having the third valve block the communication between the first valve and the tank.

3. The hydraulic circuit according to claim 1, wherein the third valve changes an amount of communication between the first valve and the tank in accordance with the operation amount of the operating device and an accumulator pressure.

4. A working machine having the hydraulic circuit according to claim 1, the working machine comprising:

a machine body; and a working device mounted in the machine body, said first and second hydraulic cylinders moving the working device up and down.

* * * * *